US012523150B1

(12) United States Patent
Hu et al.

(10) Patent No.: US 12,523,150 B1
(45) Date of Patent: Jan. 13, 2026

(54) EXCAVATION COMPENSATION METHOD FOR TUNNELLING IN DEEP ROCK ENGINEERING

(71) Applicant: China University of Mining and Technology-Beijing, Beijing (CN)

(72) Inventors: Jie Hu, Beijing (CN); Manchao He, Beijing (CN); Di Peng, Beijing (CN)

(73) Assignee: China University of Mining and Technology-Beijing, Beijing (CN)

( * ) Notice: Subject to any disclaimer, the term of this patent is extended or adjusted under 35 U.S.C. 154(b) by 0 days.

(21) Appl. No.: 19/176,160

(22) Filed: Apr. 11, 2025

(30) Foreign Application Priority Data

Nov. 21, 2024 (CN) ..... 202411667105.2

(51) Int. Cl.
*E21D 11/00* (2006.01)
*E21D 11/10* (2006.01)
*E21D 11/18* (2006.01)

(52) U.S. Cl.
CPC ..... *E21D 11/18* (2013.01); *E21D 11/107* (2013.01)

(58) Field of Classification Search
CPC ..... E21D 11/18; E21D 11/107; E21D 20/00
See application file for complete search history.

(56) References Cited

U.S. PATENT DOCUMENTS 11,982,596 B2 * 5/2024 He ..... G01N 3/313
12,084,971 B1 * 9/2024 Lei ..... E21D 11/107
12,173,606 B2 * 12/2024 Zhang ..... E02D 5/80
(Continued)

FOREIGN PATENT DOCUMENTS

CN 107060774 A * 8/2017 ..... E21D 11/18
CN 110656951 A 1/2020
(Continued)

OTHER PUBLICATIONS

Yan Peng et al., In-Situ Test Research on Influence of Excavation Method on Induced Damage Zone in Deep Tunnel, Chinese Society for Rock Mechanics and Engineering, No. 06, Jun. 15, 2011, Full Text.

(Continued)

*Primary Examiner* — Benjamin F Fiorello

(57) ABSTRACT

The present disclosure relates to the technical field of stability control of surrounding rock of tunnelling, and provides an excavation compensation method for tunnelling in deep rock engineering, including: acquiring an engineering geological information of the tunnelling in deep rock engineering; determining an engineering hazard type based on the engineering geological information; determining an excavation compensation support strategy for the surrounding rock of the tunnelling in deep rock engineering based on the engineering hazard type; and performing a supplementary support control on the surrounding rock of the tunnelling in deep rock engineering based on the excavation compensation support strategy. Through the supplementary support strategy, the difference value between a radial stress of the surrounding rock of the tunnelling in deep rock engineering and an initial crustal stress can be reduced to within a preset approximate value range, further effectively preventing a stress concentration phenomenon occurred in a tangential stress.

6 Claims, 7 Drawing Sheets

(56) References Cited

U.S. PATENT DOCUMENTS

| | | | | |
|---|---|---|---|---|
| 2021/0189536 | A1* | 6/2021 | He | C21D 9/525 |
| 2022/0228487 | A1* | 7/2022 | He | E21D 21/0026 |

FOREIGN PATENT DOCUMENTS

| | | | | | |
|---|---|---|---|---|---|
| CN | 114320459 | A | | 4/2022 | |
| CN | 116201573 | A | | 6/2023 | |
| CN | 116201574 | A | * | 6/2023 | E21D 11/10 |
| CN | 116575923 | A | | 8/2023 | |
| WO | 2024169098 | A1 | | 8/2024 | |

OTHER PUBLICATIONS

Wang Guofu et al., Stability of Surrounding Rock and Thrust Calculation of Shield Passing Through Geological Mediums, Chinese Society for Rock Mechanics and Engineering, No. 11, Nov. 15, 2015, Full Text.

* cited by examiner

EXCAVATION COMPENSATION METHOD FOR TUNNELLING IN DEEP ROCK ENGINEERING

CROSS REFERENCE TO RELATED APPLICATIONS

This application claims foreign priority of Chinese Patent Application No. 202411667105.2, filed on Nov. 21, 2024 in the China National Intellectual Property Administration, the disclosures of all of which are hereby incorporated by reference.

TECHNICAL FIELD

The present disclosure relates to the technical field of stability control of surrounding rock of tunnelling, and in particular to an excavation compensation method for tunnelling in deep rock engineering.

BACKGROUND

Sichuan-Tibet area is located at the junction of Eurasian Plate and Indian Ocean plate, and the plate tectonic activity is extremely strong, resulting in a strong activity of engineering rock mass in Sichuan-Tibet area with a movement rate of tens of millimeters per year. The complex geological background determines that the rock mass in the deep part in Sichuan-Tibet area is faced with problems such as high crustal stress, high seismic intensity, high environmental gradient, as well as strong engineering disturbance, plate disturbance, and internal and external geological dynamic disturbance. Therefore, the complex geological environment makes the tunnelling construction in Sichuan-Tibet area face numerous severe engineering problems, such as large deformation of soft rock, rock burst, and crossing active fault zone.

In the tunnelling engineering design theory of the "Collapse Arch (Slumped Arch)", which has been used for over a century, the New Austrian Tunneling Method can fully utilize the self-support capacity of the surrounding rock. Anchor rod and shotcrete are used as the main support means to control the deformation of surrounding rock, meanwhile the deformation of surrounding rock of tunnelling and the deformation of support system are monitored and measured. The surrounding rock is regarded as an essential part of the support system, and the design and construction of tunnelling or underground engineering are guided by monitoring and measuring the surrounding rock and support. The New Austrian Tunneling Method is suitable for the excavation of medium and shallow rock, where the surrounding rock has a certain self-stabilizing capacity, and only the uniaxial strength of the surrounding rock is utilized, and its technical approach is "yield before resist", and the key technology thereof is the selection of the secondary optimal support timing, and only low stress compensation is sufficient to achieve the stability of the surrounding rock, so the support material can be realized by using materials with small deformation.

However, in the deep part, the low stress compensation can no longer achieve the stability of surrounding rock, and the New Austrian Tunneling Method becomes ineffective. The first excavation effect is generated in the surrounding rock of the tunnelling, where the radial stress of the surrounding rock instantly drops to zero, and the stress state of the surrounding rock changes from a triaxial stress state to an uniaxial stress state, and the load-bearing capacity of the surrounding rock is significantly reduced; with the passage of time, the second excavation effect will generate in the surrounding rock of the tunnelling, and the tangential stress will concentrate and exceed the strength envelope of the surrounding rock, which will lead to the destruction of the surrounding rock.

Therefore, the present disclosure provides an excavation compensation method for tunnelling in deep rock engineering to solve the above-mentioned technical issues.

SUMMARY

It is an object of the present disclosure to provide an excavation compensation method for tunnelling in deep rock engineering to solve at least one of the above-mentioned technical issues. The specific solution is as following.

According to specific embodiments of the present disclosure, the present disclosure provides an excavation compensation method for tunnelling in deep rock engineering, wherein, including:

acquiring an engineering geological information of the tunnelling in deep rock engineering;

determining an engineering hazard type based on the engineering geological information;

determining an excavation compensation support strategy for a surrounding rock of the tunnelling in deep rock engineering based on the engineering hazard type, wherein the excavation compensation support strategy is configured to reduce a difference value between a radial stress of the surrounding rock of the tunnelling in deep rock engineering and an original surrounding rock stress to within a preset approximate value range, and is configured to prevent a stress concentration phenomenon occurred in a tangential stress; and performing a supplementary support control on the surrounding rock of the tunnelling in deep rock engineering based on the excavation compensation support strategy.

Advantageous Effects

The present disclosure provides an excavation compensation method for tunnelling in deep rock engineering, including: acquiring an engineering geological information of the tunnelling in deep rock engineering; determining an engineering hazard type based on the engineering geological information; determining an excavation compensation support strategy for a surrounding rock of the tunnelling in deep rock engineering based on the engineering hazard type; and performing a supplementary support control on the surrounding rock of the tunnelling in deep rock engineering based on the excavation compensation support strategy. Through the supplementary support strategy, the difference value between the radial stress of the surrounding rock of the tunnelling in deep rock engineering and the initial crustal stress can be reduced to within a preset approximate value range, and the stress concentration occurred in the tangential stress can be further effectively prevented. After the excavation of the tunnelling in deep rock engineering, high pre-stressing excavation compensation support is applied in a timely manner to restore the three-dimensional initial stress state of the surrounding rock as much as possible, so as to improve the load-bearing capacity of the surrounding rock, fully mobilize the strength of the rock mass in the deep part, and realize the effective control of the surrounding rock of the tunnelling in deep rock engineering.

DETAILED DESCRIPTION OF THE EMBODIMENTS

The optional embodiments of the present disclosure are described in detail below with reference to the accompanying drawings.

As the depth of tunnelling in deep rock engineering increases, the practical experience has shown that the traditional New Austrian Tunneling Method is no longer sufficient for tunnelling construction. The destruction in all tunnelling engineering is ultimately caused by the excavation. Before the tunnelling excavation, the rock mass is in a stable state, but after the excavation of engineering, the excavation effect is generated in the rock mass.

Figure 1:
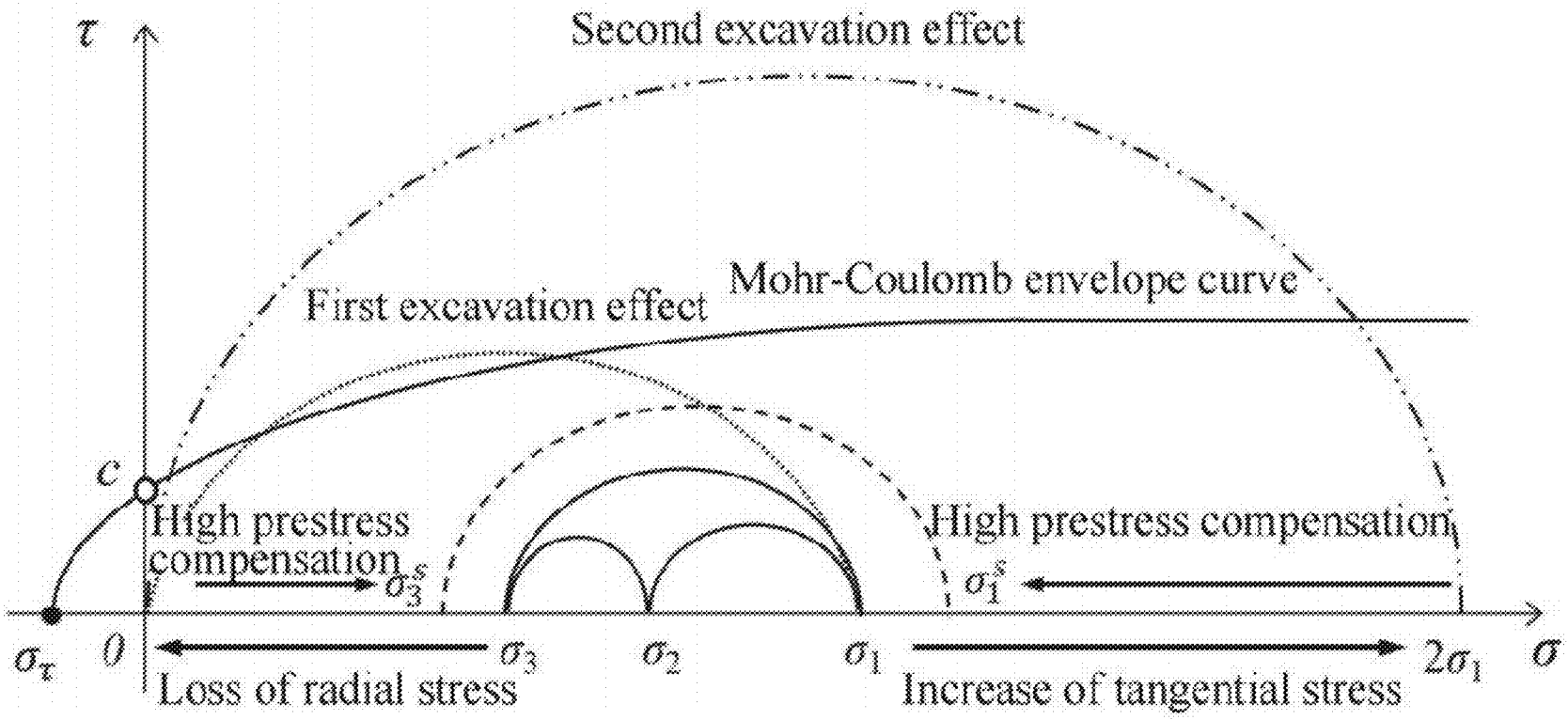
FIG. 1 is a Mohr's diagram of an excavation compensation method according to an embodiment of the present disclosure.

As shown in FIG. 1, $\sigma\tau$ represents an uniaxial tensile strength, C represents a cohesion, $\sigma\mathbf{1}$ represents a tangential stress, $\sigma\mathbf{2}$ represents an axial stress, $\sigma\mathbf{3}$ represents a radial stress, $\sigma_1^s$ represents a compensated tangential stress, and $\sigma_3^s$ represents a compensated radial stress. After the excavation of tunnelling in deep rock engineering, the first excavation effect is generated in the surrounding rock of the tunnelling, where the radial stress $\sigma\mathbf{3}$ of the surrounding rock instantly drops to zero, and the stress state of the surrounding rock changes from a triaxial stress state to an uniaxial stress state, and the load-bearing capacity of the surrounding rock is significantly reduced; with the passage of time, the second excavation effect will occur in the surrounding rock of the tunnelling, and the tangential stress $\sigma\mathbf{1}$ will concentrate and increase to twice the tangential stress $\sigma\mathbf{1}$ under hydrostatic pressure conditions, and exceed the Mohr-Coulomb strength envelope curve of the surrounding rock strength, which will lead to the destruction of the surrounding rock, large deformation disaster, and a transition of the stress state of the rock mass from a three-dimensional stress state to a two-dimensional or one-dimensional stress state.

Therefore, the present disclosure provides a compensation method to solve the above problems, namely the present disclosure provides an embodiment of an excavation compensation method for tunnelling in deep rock engineering, which includes the following steps S101-S104.

Figure 2:
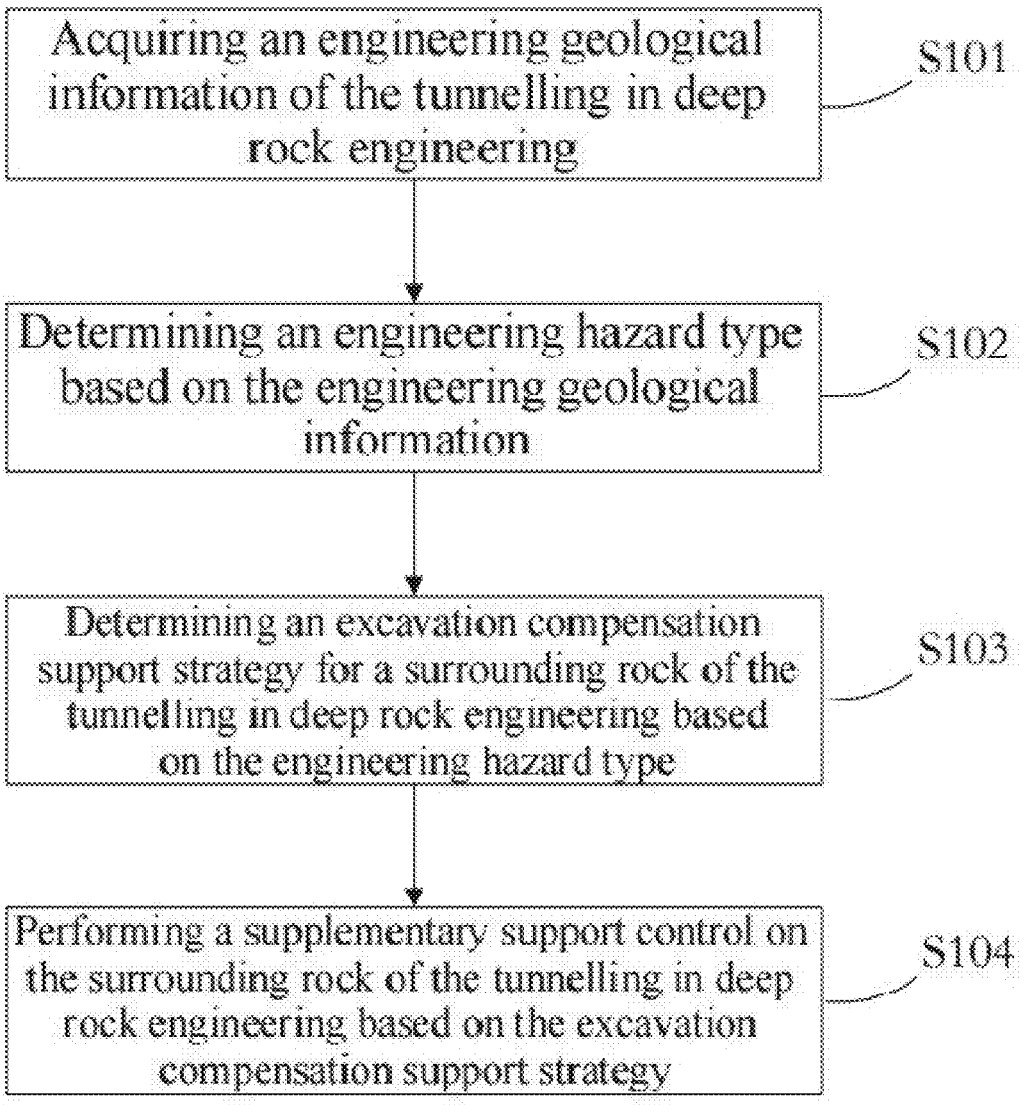
FIG. 2 is a flowchart of the excavation compensation method according to an embodiment of the present disclosure.

The embodiment of the present disclosure is described in detail below with reference to FIG. 2.

In the step S101, acquiring an engineering geological information of the tunnelling in deep rock engineering.

When the depth of an underground tunnelling exceeds one kilometer, it is referred to as the tunnelling in deep rock engineering. The rock mass of the tunnelling in deep rock engineering is in a special and complex environment characterized by high crustal stress, high ground temperature, high seepage pressure and engineering disturbance, resulting in nonlinear mechanical behaviors such as surrounding rock internal fracturing, structural change, energy accumulation and release, surrounding rock deterioration, expansion and prominent rheological effect.

The engineering geological information includes a geological structure information, a hydrogeological information, a surrounding rock lithological information, a physical and mechanical property information, and/or a surrounding rock integrity.

For the tunnelling in deep rock engineering in complex geological environment, the appropriate excavation method (e.g., drilling and blasting method or tunnelling boring machine) is firstly determined based on the engineering geological information, the disturbance load caused by the tunnelling excavation is estimated, and the range of the surrounding rock loosening zone is theoretically analyzed and measured. Based on the above engineering geological analysis theory, the theoretical value of the excavation compensation support force is calculated, and the excavation compensation support strategy for the tunnelling in deep rock engineering is determined. Then, through the real-time monitoring of the deformation value of the surrounding rock during the excavation process, a real-time monitoring data is obtained, which includes a grouting pressure, a grouting volume, a deformation data of the surrounding rock after support, an anchor rod pre-stressing/cable pre-stressing, an anchor rod pull-out resistance/cable pull-out resistance, an anchor rod deformation data/cable deformation data, a loosening zone data after support, a structural force after support, and/or a tunnelling environmental data. The excavation compensation support strategy for the surrounding rock of the tunnelling in deep rock engineering is continuously optimized based on the real-time monitoring data to ensure the stability of the surrounding rock of the tunnelling in deep rock engineering after the construction.

In the step S102, determining an engineering hazard type based on the engineering geological information.

The engineering hazard type includes a super meter level soft rock large deformation hazard type, a tunnelling rockburst hazard type, and an active fault type and/or a fault fracture zone type.

The disturbance load caused by the excavation of the tunnelling in deep rock engineering can be estimated based on the engineering geological information, through the theoretical analysis and measurement, the range of the surrounding rock loosening zone after the excavation can be determined, and engineering hazard information can be obtained.

In some specific embodiments, determining the engineering hazard type based on the engineering geological information includes the following step S102*a*.

In the step S102*a*, when determining a high crustal stress hard rock stratum information (high crustal stress hard rock stratigraphic information) based on the engineering geological information, the engineering hazard information is determined as a tunnelling rockburst hazard information based on the high crustal stress hard rock stratum information.

A tunnelling rockburst hazard is typically occurred in the high crustal stress hard rock stratum. After the excavation of the surrounding rock, a first excavation effect and a second excavation effect are generated.

The first excavation effect refers to the rapid reduction of the radial stress to zero within a preset instantaneous time period.

The second excavation effect refers to the rapid concentration and increase of the tangential stress beyond a threshold value of a preset stress value within a preset time period, for example, the threshold value of the preset stress value is twice the original rock stress value.

In the step S103, determining an excavation compensation support strategy for a surrounding rock of the tunnelling in deep rock engineering based on the engineering hazard type.

Wherein the excavation compensation support strategy is configured to reduce a difference value between a radial stress of the surrounding rock of the tunnelling in deep rock engineering and an original surrounding rock stress to within a preset approximate value range, and is configured to prevent a stress concentration phenomenon occurred in a tangential stress.

For example, the preset approximate value range includes: 0 to 30% of the radial stress of the surrounding rock of the tunnelling in deep rock engineering, such as reducing the difference value to 0, or reducing the difference value to 5% of the radial stress of the surrounding rock of the tunnelling in deep rock engineering, or reducing the difference value to 10% of the radial stress of the surrounding rock of the tunnelling in deep rock engineering, or reducing the difference value to 20% of the radial stress of the surrounding rock of the tunnelling in deep rock engineering, or reducing the difference value to 10% of the radial stress of the surrounding rock of the tunnelling in deep rock engineering.

In some specific embodiments, determining the excavation compensation support strategy for the surrounding rock of the tunnelling in deep rock engineering based on the engineering hazard type includes the following step S103*a*.

In the step S103*a*, when the engineering hazard type is characterized as a super meter level soft rock large deformation hazard type, the excavation compensation support strategy is determined as a high pre-stressing and strong-toughness anchor net combination strategy, and a truss-type arch load-bearing strategy.

Figure 5:
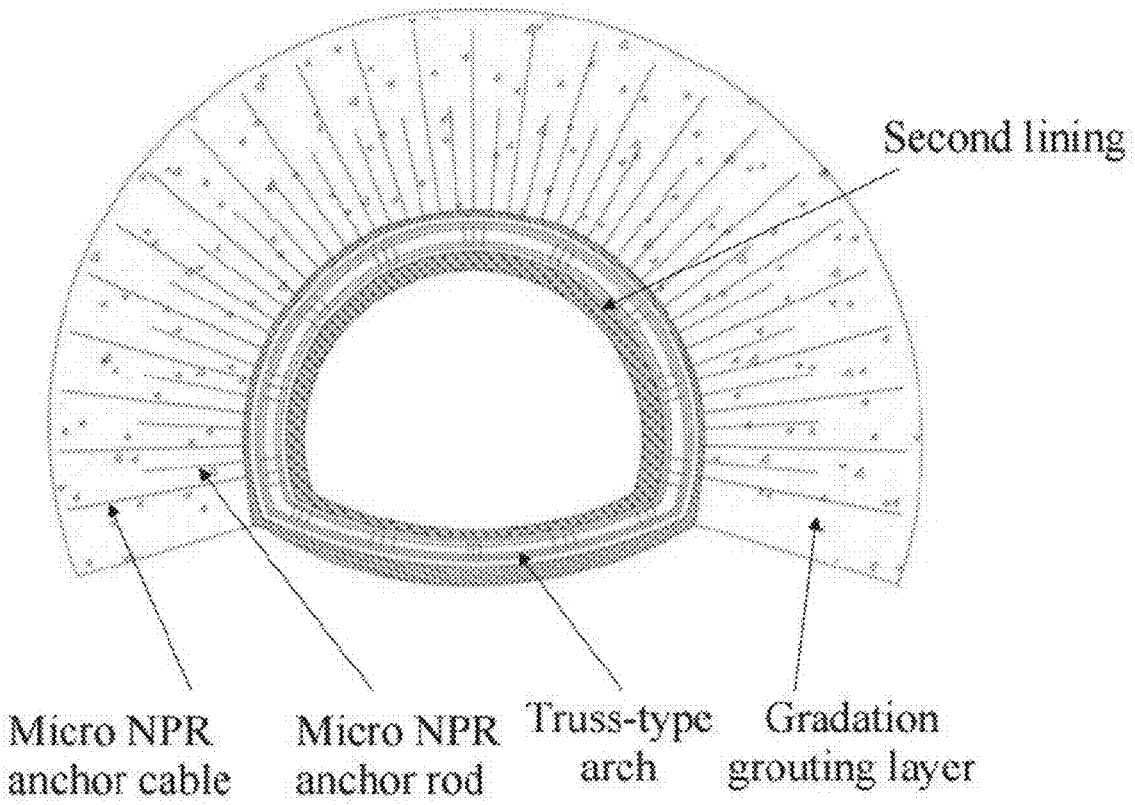
FIG. 5 is a transverse schematic diagram of an excavation compensation construction of the tunnelling in deep rock engineering in the excavation compensation method according to an embodiment of the present disclosure.
Figure 6:
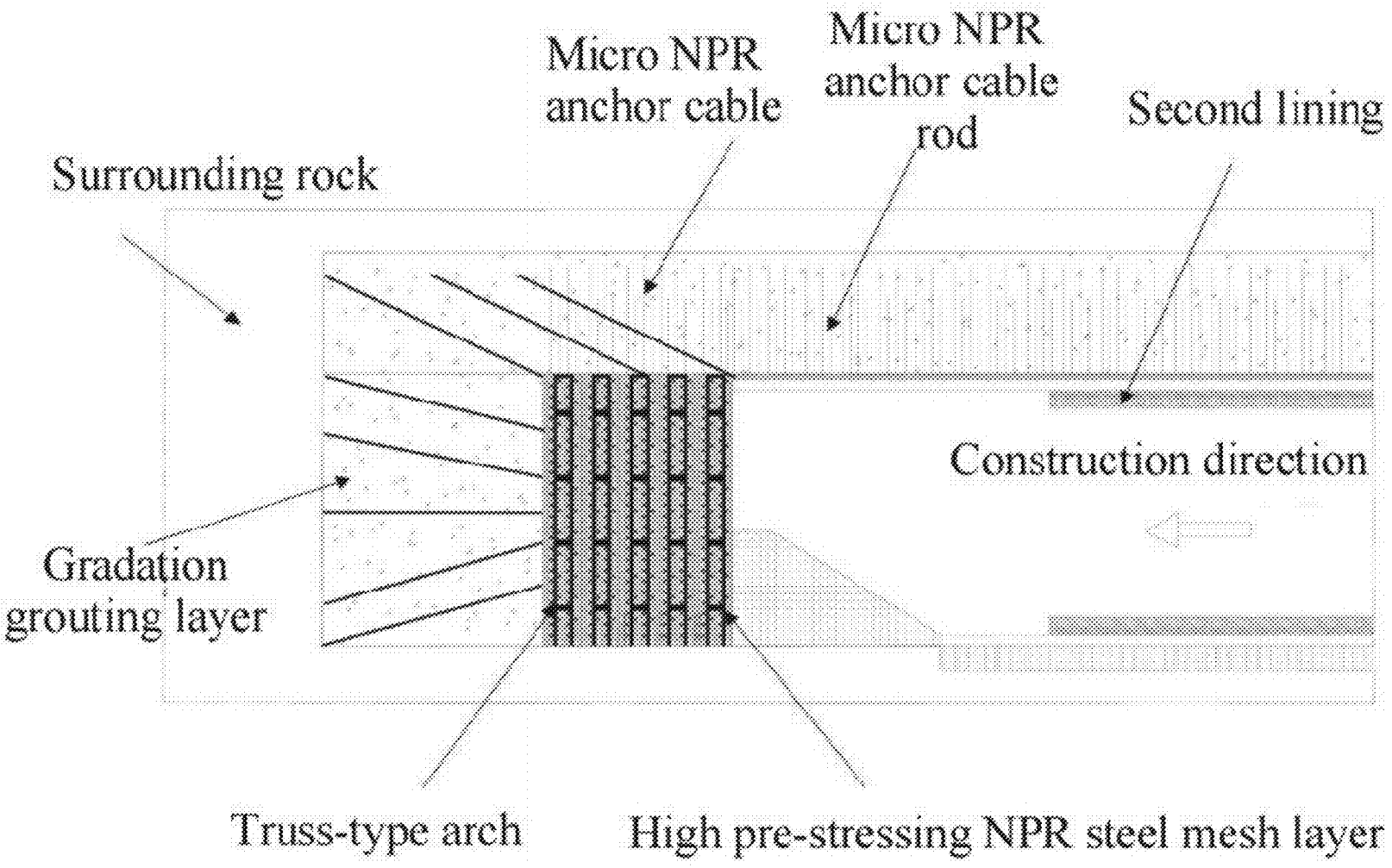
FIG. 6 is a radial schematic diagram of the excavation compensation construction of the tunnelling in deep rock engineering in the excavation compensation method for tunnelling in deep rock engineering according to an embodiment of the present disclosure.

In the engineering of the tunnelling in deep rock engineering, in regard to the large deformation hazard of the super meter level soft rock, it is difficult to achieve effective prevention and control effect by adopting traditional countermeasures, such as increase of reserved deformation amount, double-layer steel arch support and increase of concrete thickness of second lining, as shown in FIGS. 5 and 6.

Therefore, this specific embodiment provides a high pre-stressing and strong-toughness anchor net combination strategy, and a truss-type arch load-bearing strategy.

In some specific embodiments, the high pre-stressing and strong-toughness anchor net combination strategy includes the following steps S1-S3.

In the step S1, within a preset safety time period after an excavation of the tunnelling in deep rock engineering, a first support member is configured to perform a pre-stress support compensation with a preset strength on a radial load of a clearance of the surrounding rock of the tunnelling in deep rock engineering.

The high pre-stressing and strong-toughness anchor net combination strategy requires the support of the surrounding rock within a short time period. For example, the preset safety time period is half an hour.

The first support member includes a micro NPR (Negative Poisson's Ratio) anchor rod and/or a micro NPR anchor cable, a NPR anchorage, a NPR anchor plate, which are made of a high-strength and high-toughness NPR new type steel, and a high-performance durable resin anchoring agent, as shown in FIGS. 5 and 6.

In the deep part of the surrounding rock, the durable resin anchoring agent is configured to tightly bond the micro NPR anchor rod or the micro NPR anchor cable with the surrounding rock in the deep; on the surface of the surrounding rock, the NPR anchorage or NPR anchor plate are configured in conjunction to lock the micro NPR anchor rod or the micro NPR anchor cable.

In the step S2, a second support member is configured to disperse and transfer the radial load along a surface of the surrounding rock.

The second support member includes a NPR steel mesh, a NPR corrugated steel plate, and a NPR steel fiber concrete, which are made of the high-strength and high-toughness NPR new type steel.

The NPR steel mesh, the NPR corrugated steel plate, and the NPR steel fiber concrete are mainly configured to disperse and transfer the radial load along the surface of the surrounding rock. The NPR steel mesh is laid close to the surface of the surrounding rock. The end of the micro NPR anchor rod or the micro NPR anchor cable is passed through the hole in the NPR corrugated steel plate and is locked by the NPR anchorage and the NPR anchor plate.

In the step S3, a precast concrete with a preset thickness is sprayed on the surface of the surrounding rock.

The preset thickness ranges from 10 to 20 cm. Specifically, it depends on the degree of the surrounding rock.

The precast concrete includes the NPR steel fiber concrete.

Figure 3:
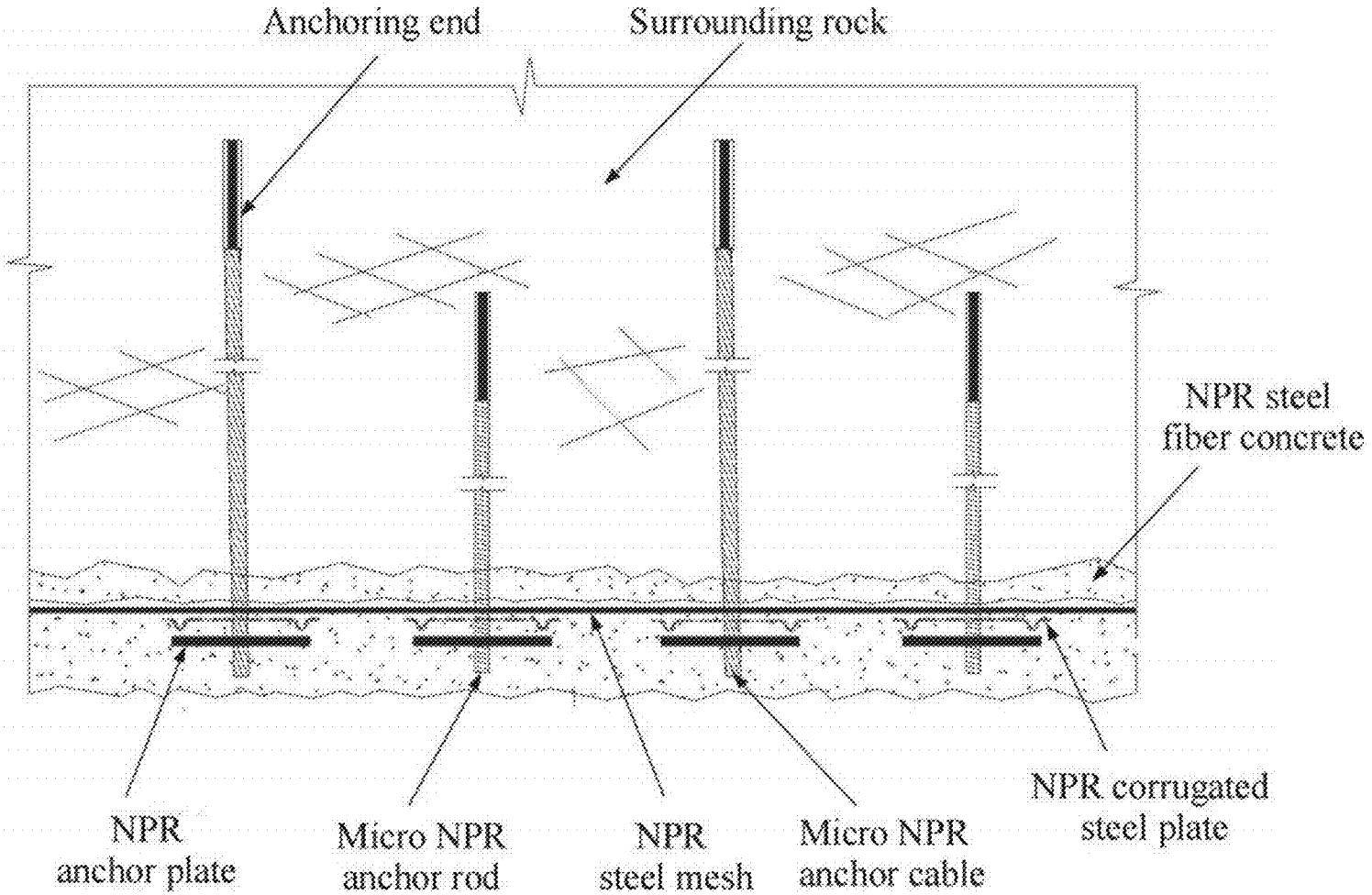
FIG. 3 is a construction schematic diagram of a high pre-stressing and strong-toughness anchor net combination strategy in the excavation compensation method according to an embodiment of the present disclosure.

As shown in FIG. 3, during the construction, the surface of the surrounding rock of the tunnelling in deep rock engineering is divided into the following three layers from shallow to deep, the first layer is the NPR steel fiber concrete spray layer; the second layer is consisted of the NPR anchorage and the NPR anchor plate pressing against the NPR corrugated steel plate and the NPR steel mesh, all of those have holes through which the micro NPR anchor rod or the micro NPR anchor cable pass; the third layer is consisted of the anchoring end of the micro NPR anchor rod or the micro NPR anchor cable bonded to the deep surrounding rock by the durable resin anchoring agent. A high pre-stressing NPR anchor net layer with a "point-line-surface" structure centered on the micro NPR anchor rod or the micro NPR anchor cable is formed, as shown in FIG. 6. A "point-line-surface" high pre-stressing NPR anchor net layer with the micro NPR anchor rod or the micro NPR anchor cable as the main body, as shown in FIG. 6.

Specifically, for the high pre-stressing and strong-toughness anchor net combination strategy, the pre-tightening force is applied to the micro NPR anchor rod or the micro NPR anchor cable by reverse tensioning of the tensioning jack, and the high pre-stressing compensation, shown in FIG. 1, is performed on the excavated surrounding rock in time, so as to achieve the purpose of reducing or controlling the risk of the fragmentation and instability of the surrounding rock. The high pre-stressing and strong-toughness anchor net combination strategy is configured to lock the pre-stress in time by quickly applying pre-stress to the surrounding rock.

In some specific embodiments, the truss-type arch load-bearing strategy includes the following steps.

In a radial direction of the surrounding rock of the tunnelling in deep rock engineering, an I-beam with a preset length is configured to fixedly connect single-layer steel arches into multi-layer steel arches.

In an axial direction of the tunnelling in deep rock engineering, a T-beam is configured to fixedly connect a plurality of the multi-layer steel arches with a preset interval length, and a rebar with a preset diameter is configured to fixedly connect the multi-layer steel arches in a diagonal and herringbone manner, to form a truss-type arch, as shown in FIGS. 5 and 6.

Ordinary arches commonly used in tunnelling in deep rock engineering are typically made of single-layer I-beam or shaped steel. Because of the deformation and extrusion of surrounding rock, the damage caused in the arch is mainly stiffness damage such as bending deformation and twisting deformation, and strength damage such as shear damage and tension damage. The fundamental reason lies in the low structural rigidity and poor integrity of the arch and the relatively weak connection between the arch.

The I-beam, as a heavy steel, has the advantage of high material strength, strong tensile, compressive, and strong shear resistance. The truss-type arch load-bearing strategy is configured to give full play to its advantages through mechanical design, and improve its ability to resist deformation, torsion and shear. During large deformation of the surrounding rock, the truss-type arch can maintain the stability of the whole structure by relying on its excellent load-bearing characteristics during the interaction with surrounding rock.

The truss-type arch is an integrated structural support member. In the radial direction of the surrounding rock of the tunnelling in deep rock engineering, a short I-beam (e.g., with a preset length of 10-15 cm), as a connecting member, is configured to connect the single-layer steel arches into the multi-layer steel arches (e.g., the multi-layer steel arches includes double-layer steel arches).

In the axial direction of the tunnelling in deep rock engineering, a T-beam is configured to fixedly connect a plurality of the multi-layer steel arches with a preset interval length (e.g., 100 cm) through the welding, and a rebar with a preset diameter (e.g., 22 mm) is configured to fixedly connect the multi-layer steel arches in a diagonal and herringbone manner, so as to enhance the deformation stiffness of the truss-type arch.

The main advantage of the truss-type arch is that it can convert the bending and torsional parts of the steel arches into tensile, compressive, or shear properties through structural optimization design. The transverse connection of the truss-type arch is configured to balance the uneven longitudinal load of the surrounding rock of the tunnelling in deep rock engineering, allowing the load to act relatively uniformly on the whole truss; the main function of the radial connection between truss-type arches is to transmit the unbalanced force from the radial direction of the tunnelling, which finally make the whole stress of the truss-type arch uniform, thus improving the load-bearing of the truss-type arch.

In terms of the bending resistance of the truss-type arch, due to the reinforced radial connection of the truss-type arch, its bending moment performance is still superior to that of a single-layer arch, that is, under the same load, a single-layer arch will suffer greater bending moment and is most likely to be damaged.

In terms of shear resistance of the truss-type arch, the damage main action point of steel arches is the radial stress point of the arch, that is, the main damage of steel arches is primarily the shear damage. For the truss-type arch, the multi-layer arches are interconnected in the radial direction, the shear resistance of the truss-type arch is several times that of the single-layer arch, for example, the shear resistance of a double-layer arch is 1.6 times that of the single-layer arch.

In terms of the torsional resistance of the truss-type arch, due to the longitudinal connection and transverse connection of the truss-type arch, the integrity and stiffness of its whole structure are enhanced, under the same load, the torque of the truss-type arch is minimized, and its torsional resistance is several times that of the single-layer arch, for example, the torque resistance of the double-layer arch is 2.65 times that of the single-layer arch.

In this specific embodiment, when the engineering hazard information is characterized as a super meter level soft rock large deformation hazard information, the excavation compensation support strategy is determined as a high pre-stressing and strong-toughness anchor net combination strategy, and a truss-type arch load-bearing strategy.

Firstly, in response to the characteristics of tunnelling in deep rock engineering with large loosening zone, significant deformation, and rapid deformation rate in the soft rock, the high pre-stressing and strong-toughness anchor net combination strategy is provided. The purpose is to fully utilize the compressive characteristics of the surrounding rock of the tunnelling in deep rock engineering through the micro NPR anchor rod or the micro NPR anchor cable to connect the shallow loosened surrounding rocks through the micro NPR anchor rod or the micro NPR anchor cable, apply a preset pre-stress (e.g., 30 tons) to the micro NPR anchor rod or the micro NPR anchor cable, increase the friction between the shallow loosened surrounding rocks, and form a stable connection between the shallow surrounding rock and deep surrounding rock through the micro NPR anchor rod or the micro NPR anchor cable. By quickly applying and locking pre-stress based on the high pre-stressing and strong-toughness anchor net combination strategy, the deformation rate and the deformation magnitude of the soft rock can be effectively reduced.

The tunnelling in deep rock engineering is often affected by tectonic stress, leading to asymmetric large deformation. The truss-type arch load-bearing strategy can fully utilize the advantages of the I-beam, enhancing its resistance to deformation, torsion, and shear through the mechanical design. The transverse connection of the truss-type arch can mainly balance the uneven longitudinal load of the surrounding rock, allowing the load to act relatively uniformly on the whole arch. The radial connection between truss-type arches can mainly transmit unbalanced forces from the radial direction of the tunnelling, ultimately ensuring that the whole arch is uniformly stressed and improving its load-load-bearing capacity. This can ensure the stability of the whole structure of the truss-type arch during interaction with the surrounding rock. The truss-type arch load-bearing strategy can replace the commonly used double-layer steel arch support strategy.

In some specific embodiments, determining the excavation compensation support strategy for the surrounding rock of the tunnelling in deep rock engineering based on the engineering hazard type includes step 103*b*.

In the step 103*b*, when the engineering hazard type is characterized as the tunnelling rockburst hazard type, the excavation compensation support strategy is determined as the high pre-stressing and strong-toughness anchor net combination strategy, and an energy gathering directional blasting strategy.

When the engineering hazard information is characterized as a tunnelling rockburst hazard information, the surrounding rock can generate the first excavation effect and second excavation effect after the excavation. Therefore, the high pre-stressing and strong-toughness anchor net combination strategy is used to address the first excavation effect, and the energy gathering directional blasting strategy is used to address the second excavation effect.

In some specific embodiments, the energy gathering directional blasting strategy includes the following steps.

During a construction of the tunnelling in deep rock engineering, a plurality of energy gathering directional tubes are embedded in a rock mass within a preset excavation range, and explosives in the energy gathering directional tubes are detonated to generate a high-temperature and high-pressure gas.

A row of linearly distributed directional energy gathering holes defined in at least one set direction of each energy gathering directional tube are configured to form the high-temperature and high-pressure gas into a high-energy flow, which is outwardly concentrated on a corresponding hole wall to generate a tensile stress, and the surrounding rock of the hole wall is tensioned and cracked along the set direction under the tensile stress.

The rock mass within the preset excavation range is directionally tensioned, fractured and formed through a superimposing stress field generated by each row of the directional energy gathering holes, and a directional blasting cutting surface is formed.

Figure 4:
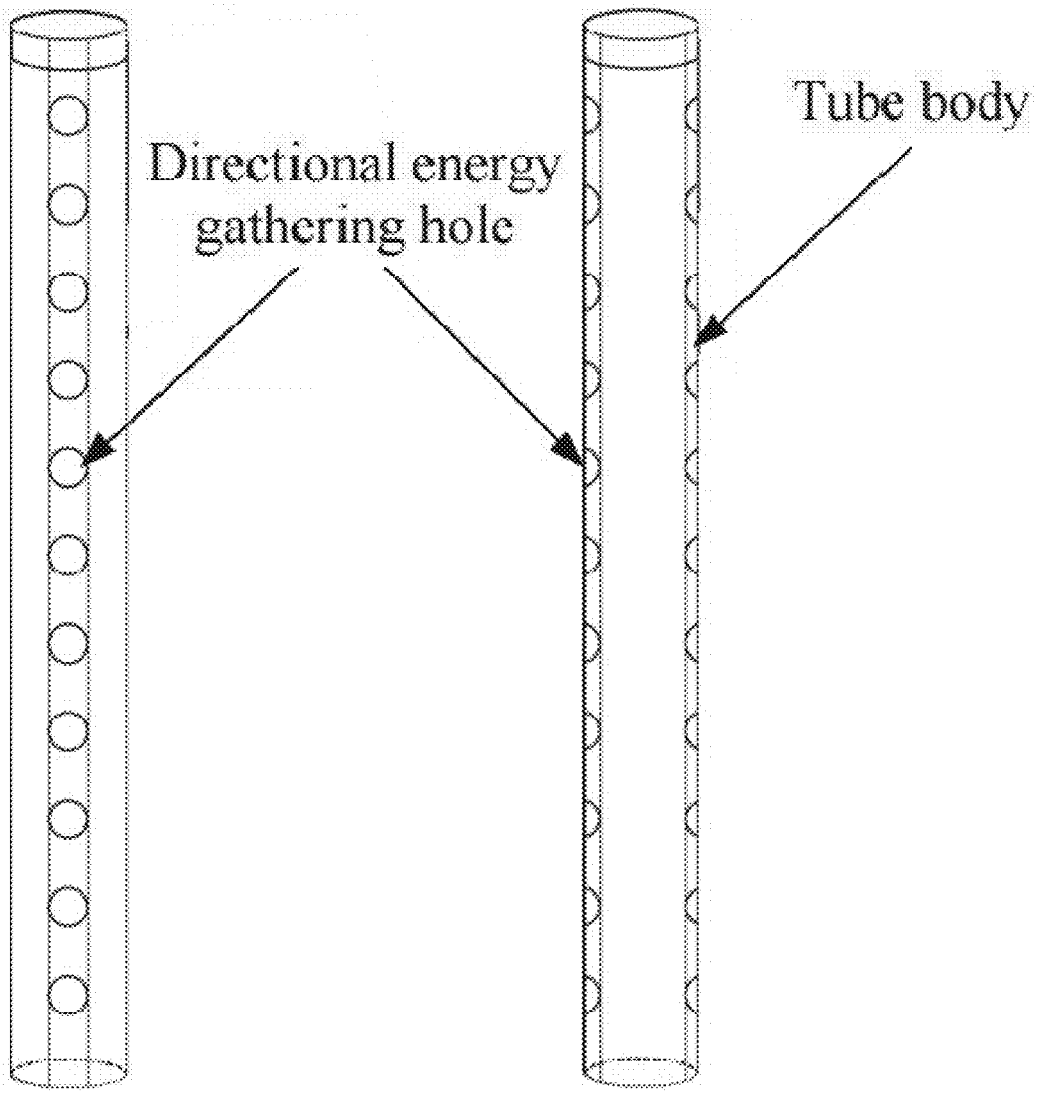
FIG. 4 is a schematic diagram of an energy gathering directional tube in the excavation compensation method according to an embodiment of the present disclosure.

The energy gathering directional tube includes a tube body, directional energy gathering holes, explosive cartridges, detonators, stemming, and detonating primers. As shown in FIG. 4, a row of linearly distributed directional energy gathering holes are defined on the tube body. The explosive cartridges, the detonators, the stemming, and the detonating primers are provided inside the tube body.

The energy gathering directional blasting strategy can utilize the characteristic that rocks are resistant to compression but susceptible to tension. When the explosives (the explosive cartridges, the detonators, the stemming, and the detonating primers) in the energy gathering directional tube are detonated, a large amount of high-temperature and high-pressure gas is released in a very short time (e.g., 0.05-0.5 seconds). The energy gathering directional tube can instantaneously suppress the gas, providing an instantaneous pressure relief space through the directional energy gathering holes preferentially, forming a high-energy flow at the directional energy gathering holes, which is concentrated to act on the corresponding hole wall, so as to generate radial initial cracks; the subsequent high-temperature and high-pressure gas can continue to be released through the directional energy gathering holes, the radial initial cracks are driven and a powerful "gas wedge" is formed within them, resulting in continuous instability of cracks, the tensile stress concentration is occurred in the set direction, accelerating the directional propagation of cracks, and ultimately causing the rock mass to stretch and crack along the set direction. At the same time, due to the suppress and buffering effect of the tube body of the energy gathering directional tube, the stress acting on the non-set direction of the hole wall is significantly reduced, providing a certain degree of protection to the rock mass in the non-set direction.

When a plurality of the directional energy gathering holes are blasted simultaneously, a superimposing stress field is generated between the directional energy gathering holes, the tensile stress between adjacent directional energy gathering holes is increased; if the spacing between the directional energy gathering holes is appropriate, the cracks between adjacent directional energy gathering holes will connect, and a directional single fracture surface is formed. The essence of the energy gathering directional blasting strategy is to use the energy gathering directional tube to generate the uniform pressure on the hole wall in the non-set direction, and generate the concentrated tensile stress in the set direction, leveraging the characteristic that rocks are resistant to compression but susceptible to tension, thereby achieving directional tensile fracture of the rock mass.

The energy gathering directional blasting strategy is configured to achieve the directional blasting, reduce the over-excavation in the tunnelling, decrease the damage to the surrounding rock, and avoid the expansion of the loosening zone caused by the blasting excavation, which can lead to the instability of the surrounding rock.

In this specific embodiment, in order to reduce the concentration of the tangential stress in the surrounding rock after the excavation of the tunnelling in deep rock engineering, the energy gathering directional tube is configured to convert the high-temperature and high-pressure airflow generated by explosive explosions into point-line energy jets through the directional energy gathering holes. The energy jets are configured to concentrate the tensile stress on the local area of the directional energy gathering holes, other areas from uniform pressure are protected, and the directional cracks are generated in the rock, which is resistant to compression but susceptible to tension.

By adopting the energy gathering directional blasting strategy, multi-hole blasting is performed in the rock mass. In the rock mass, one connected directional fracture is formed along the set direction of the directional energy gathering holes, thereby forming the directional blasting, reducing the damage to the surrounding rock, and avoiding the expansion of the loosening zone caused by the blasting excavation, which can affect the stability of the surrounding rock. The energy gathering directional blasting strategy is configured to precise excavation of the tunnel face of the tunnelling in deep rock engineering, ensuring the smoothness of the surrounding rock after the excavation of the tunnelling, reducing the surface roughness of the hard rock tunnelling, and decreasing the rockburst hazard caused by the local stress concentration.

In some specific embodiments, determining the excavation compensation support strategy for the surrounding rock of the tunnelling in deep rock engineering based on the engineering hazard type includes step 103*c*.

In the step 103*c*, when the engineering hazard information is characterized as an active fault type and/or a fault fracture zone type, the excavation compensation support strategy is determined as the high pre-stressing and strong-toughness anchor net combination strategy, the truss-type arch load-bearing strategy, and a gradation grouting control strategy.

In some specific embodiments, as shown in FIGS. 5 and 6, the gradation grouting control strategy includes the following steps.

During a stratum construction of an active fault and/or a fault fracture zone, on a tunnel face of the tunnelling in deep rock engineering, a preset low grouting pressure is configured to make a conduction pressure of a coarse-grained cement slurry overcome an initial crustal stress of a stratum and a tensile strength of the surrounding rock, and original pores and/or fractures are expanded in the stratum, or new fractures and/or pores are formed.

A preset high grouting pressure is configured to force fine-grained particles to expand into pores and/or the fractures, new fractures are initiated and expanded, and a grout stop wall with a preset thickness is ultimately formed.

The gradation grouting control strategy is an advanced support technology proposed for the tunnelling in deep rock engineering crossing the stratum of the active faults and/or the fault fracture zones, which may cause a large deformation hazard or a mud and water inrush hazard in the surrounding rock.

The tunnel face, also known as the working face, is a term used in tunnelling construction. It refers to the continuously advancing working surface during the tunnelling excavation (in the coal mining, the mining, or the tunnelling engineering).

The gradation grouting control strategy is configured to prevent the penetration of fissure water inside the active fault and/or the fault fracture zone, fundamentally changing the structure of deeply fractured rock mass in the tunnelling in deep rock engineering, and improving the strength of the surrounding rock.

The preset thickness ranges from 2 to 2.5 meters, and the diameters of the coarse-grained grouting pipe and fine-grained grouting pipe are both 60 mm.

The coarse-grained cement slurry is an early-strength sulfoaluminate single-liquid slurry with a HPC grouting additive, with a particle size of about 20 μm. The preset low grouting pressure ranges from 2 to 3 MPa, and the grouting flow rate is about 30 L/min.

The fine-grained cement slurry is an ultra-fine cement, with a particle size of about 2 μm. The preset high grouting pressure ranges from 8 to 10 MPa, and the grouting flow rate is about 20 L/min.

After grouting, a 3-day curing period is required to allow the grouting fluid to fully solidify.

Through the gradation grouting control strategy, a gradation grouting layer is generated, as shown in FIGS. 5 and 6, the gaps in the surrounding rock of the tunnelling in deep rock engineering are filled, the internal friction angle and the cohesion of the rock mass are increased, and the properties of the surrounding rock are improved; the grouting fluid can also squeeze out air and water in the gaps, resisting the penetration of the external water, significantly improving the anti-seepage performance of the surrounding rock, forming a complete grout vein network and a stable grout vein skeleton, improving the micro structure of the surrounding rock, enhancing the whole integrity of the surrounding rock, and providing stable anchoring points for the micro NPR anchor rod or the micro NPR anchor cable, facilitating the full performance of the subsequent micro NPR anchor rod or the micro NPR anchor cable.

In the step S104, performing a supplementary support control on the surrounding rock of the tunnelling in deep rock engineering based on the excavation compensation support strategy.

In the embodiment of the present disclosure, including: acquiring an engineering geological information of the tunnelling in deep rock engineering; determining an engineering hazard type based on the engineering geological information; determining an excavation compensation support strategy for a surrounding rock of the tunnelling in deep rock engineering based on the engineering hazard type; and performing a supplementary support control on the surrounding rock of the tunnelling in deep rock engineering based on the excavation compensation support strategy. Through the supplementary support strategy, the difference value between a radial stress of the surrounding rock of the tunnelling in deep rock engineering and an initial crustal stress can be reduced to within a preset approximate value range, further effectively preventing a stress concentration phenomenon occurred in a tangential stress. After the excavation of the tunnelling in deep rock engineering, a high pre-stressing excavation compensation support is applied in a timely manner to restore the three-dimensional initial stress state of the surrounding rock as much as possible, so as to improve the load-bearing capacity of the surrounding rock, fully mobilize the strength of the rock mass in the deep part, and realize the effective control of the surrounding rock of the tunnelling in deep rock engineering.

Figure 7:
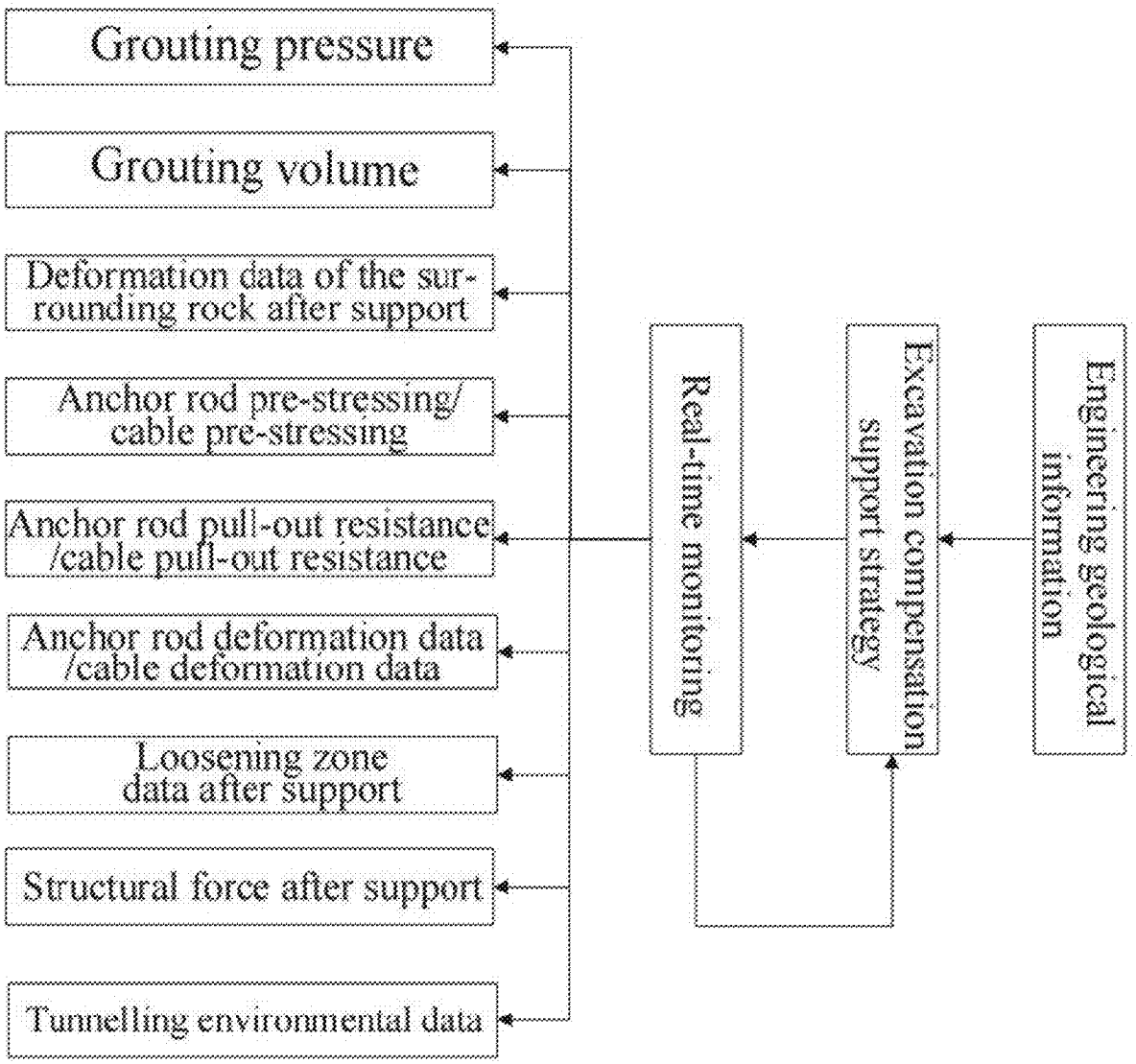
FIG. 7 is a schematic diagram of a monitoring process after the excavation compensation method according to an embodiment of the present disclosure.

In some specific embodiments, as shown in FIG. 7, after performing a supplementary support control on the surrounding rock of the tunnelling in deep rock engineering based on the excavation compensation support strategy, further including the following steps S110-1 to S110-3.

In the step S110-1, performing a real-time monitoring on the surrounding rock of the tunnelling in deep rock engineering after the supplementary support control to obtain a real-time monitoring data.

The real-time monitoring data includes a grouting pressure, a grouting volume, a deformation data of the surrounding rock after support, an anchor rod pre-stressing/cable pre-stressing, an anchor rod pull-out resistance/cable pull-out resistance, an anchor rod deformation data/cable deformation data, a loosening zone data after support, a structural force after support, and/or a tunnelling environmental data.

In the step S110-2, determining a new excavation compensation support strategy based on the real-time monitoring data when an abnormality is detected in the real-time monitoring data.

In the step S110-3, performing the supplementary support control on the surrounding rock of the tunnelling in deep rock engineering based on the new excavation compensation support strategy.

As shown in FIG. 7, this specific embodiment can determine the excavation compensation support strategy for the surrounding rock of the tunnelling in deep rock engineering based on the engineering geological information, then perform the construction according to the excavation compensation support strategy. During the construction process, the real-time monitoring of the surrounding rock of the tunnelling in deep rock engineering is continuously performed, and the excavation compensation support strategy for the surrounding rock of the tunnelling in deep rock engineering is continuously optimized based on the real-time monitoring data to ensure the stability of the surrounding rock of the tunnelling in deep rock engineering after the construction.

The invention claimed is:

1. An excavation compensation method for tunnelling in deep rock engineering, wherein, comprising:

acquiring an engineering geological information of the tunnelling in deep rock engineering;

determining an engineering hazard type based on the engineering geological information;

determining an excavation compensation support strategy for a surrounding rock of the tunnelling in deep rock engineering based on the engineering hazard type, wherein the excavation compensation support strategy is configured to reduce a difference value between a radial stress of the surrounding rock of the tunnelling in deep rock engineering and an original surrounding rock stress to within a preset approximate value range, and is configured to prevent a stress concentration occurred in a tangential stress; and performing a supplementary support control on the surrounding rock of the tunnelling in deep rock engineering based on the excavation compensation support strategy;

wherein the engineering geological information comprises a geological structure information, a hydrogeological information, a surrounding rock lithological information, a physical and mechanical property information, and/or a surrounding rock integrity;

wherein the engineering hazard type comprises a super meter level soft rock large deformation hazard type, a tunnelling rock burst hazard type, and an active fault type and/or a fault fracture zone type;

wherein, determining the engineering hazard type based on the engineering geological information comprises:

when determining a high crustal stress hard rock stratum information based on the engineering geological information, the engineering hazard type is determined as a tunnelling rock burst hazard type based on the high crustal stress hard rock stratum information;

wherein, determining the excavation compensation support strategy for the surrounding rock of the tunnelling in deep rock engineering based on the engineering hazard type comprises:

when the engineering hazard type is characterized as the tunnelling rock burst hazard type, the excavation compensation support strategy is determined as the high pre-stressing and strong-toughness anchor net combination strategy, and an energy gathering directional blasting strategy;

wherein, the energy gathering directional blasting strategy comprises:

during a construction of the tunnelling in deep rock engineering, a plurality of energy gathering directional tubes are embedded in a rock mass within a preset excavation range, and explosives in the energy gathering directional tubes are detonated to generate a high-temperature and high-pressure gas; and a row of linearly distributed directional energy gathering holes respectively defined in at least one set direction of each energy gathering directional tube are configured to form the high-temperature and high-pressure gas into a high-energy flow, which is outwardly concentrated on a corresponding hole wall to generate a tensile stress, and the surrounding rock of the hole wall is tensioned and cracked along the set direction under the tensile stress; and the rock mass within the preset excavation range is directionally tensioned and fractured through a superimposing stress field generated by each row of the directional energy gathering holes, and a directional blasting cutting surface is formed.

2. The excavation compensation method for tunnelling in deep rock engineering according to claim 1, wherein, determining the excavation compensation support strategy for the surrounding rock of the tunnelling in deep rock engineering based on the engineering hazard type comprises:

when the engineering hazard type is characterized as a super meter level soft rock large deformation hazard type, the excavation compensation support strategy is determined as a high pre-stressing and strong-toughness anchor net combination strategy, and a truss-type arch load-bearing strategy.

3. The excavation compensation method for tunnelling in deep rock engineering according to claim 2, wherein, the high pre-stressing and strong-toughness anchor net combination strategy comprises:

within a preset safety time period after an excavation of the tunnelling in deep rock engineering, a first support member is configured to perform a pre-stress support compensation with a preset strength on a radial load of a clearance of the surrounding rock of the tunnelling in deep rock engineering; and a second support member is configured to disperse and transfer the radial load along a surface of the surrounding rock; and a precast concrete with a preset thickness is sprayed on the surface of the surrounding rock.

4. The excavation compensation method for tunnelling in deep rock engineering according to claim 1, wherein, determining the excavation compensation support strategy for the surrounding rock of the tunnelling in deep rock engineering based on the engineering hazard type comprises:

when the engineering hazard type is characterized as an active fault type and/or a fault fracture zone type, the excavation compensation support strategy is determined as the high pre-stressing and strong-toughness anchor net combination strategy, the truss-type arch load-bearing strategy, and a gradation grouting control strategy.

5. The excavation compensation method for tunnelling in deep rock engineering according to claim 4, wherein, the gradation grouting control strategy comprises:

during a stratum construction of an active fault and/or a fault fracture zone, on a tunnel face of the tunnelling in deep rock engineering, a preset low grouting pressure is configured to make a conduction pressure of a coarse-grained cement slurry overcome an initial crustal stress of a stratum and a tensile strength of the surrounding rock, and original pores and/or fractures are expanded in the stratum; and a preset high grouting pressure is configured to force fine-grained particles to expand into pores and/or the fractures, new fractures are initiated and expanded, and a grout stop wall with a preset thickness is ultimately formed.

6. The excavation compensation method for tunnelling in deep rock engineering according to claim 1, wherein, after performing a supplementary support control on the surrounding rock of the tunnelling in deep rock engineering based on the excavation compensation support strategy, the excavation compensation method for tunnelling in deep rock engineering further comprises:

performing a real-time monitoring on the tunnelling in deep rock engineering after the supplementary support control to obtain a real-time monitoring data;

determining a new excavation compensation support strategy based on the real-time monitoring data when an abnormality is detected in the real-time monitoring data; and performing the supplementary support control on the surrounding rock of the tunnelling in deep rock engineering based on the new excavation compensation support strategy.

* * * * *